US005895778A

United States Patent [19]

McHenry et al.

[11] Patent Number: 5,895,778

[45] Date of Patent: Apr. 20, 1999

[54] POLY(NEOPENTYL POLYOL) ESTER BASED COOLANTS AND IMPROVED ADDITIVE PACKAGE

[75] Inventors: Michael A. McHenry, Sayreville; Dale D. Carr, Morristown; Thomas G. Schaefer, Parlin, all of N.J.

[73] Assignee: Hatco Corporation, Fords, N.J.

[21] Appl. No.: 08/918,177

[22] Filed: Aug. 25, 1997

[51] Int. Cl.[6] ..... C10M 105/38

[52] U.S. Cl. ..... 508/495; 508/485; 252/68

[58] Field of Search ..... 508/485, 495; 252/68

[56] References Cited

U.S. PATENT DOCUMENTS

| | | | |
|---|---|---|---|
| 2,622,707 | 12/1952 | Faus . | |
| 3,073,514 | 1/1963 | Bailey et al. . | |
| 3,129,877 | 4/1964 | Nilsson et al. . | |
| 3,309,318 | 3/1967 | Aylesworth et al. | 508/485 |
| 3,670,013 | 6/1972 | Leibfried . | |
| 3,694,382 | 9/1972 | Kleiman et al. | 508/485 |
| 4,064,058 | 12/1977 | Walker . | |
| 4,072,619 | 2/1978 | Williams et al. . | |
| 4,113,635 | 9/1978 | Sakurai et al. . | |
| 4,175,045 | 11/1979 | Timony . | |
| 4,302,343 | 11/1981 | Carswell et al. . | |
| 4,477,383 | 10/1984 | Beimesch et al. | 508/485 |
| 4,826,633 | 5/1989 | Carr et al. . | |
| 4,851,144 | 7/1989 | McGraw et al. | 252/52 A |
| 5,275,749 | 1/1994 | Kugel et al. . | |
| 5,486,299 | 1/1996 | Short | 508/485 |
| 5,612,299 | 3/1997 | Short | 508/485 |
| 5,705,086 | 1/1998 | Ardito et al. | 508/485 |
| 5,726,135 | 3/1998 | Khorramian | 508/485 |
| 5,744,434 | 4/1998 | Schlosberg et al. | 508/485 |
| 5,830,833 | 11/1998 | Grasshoff et al. | 508/485 |

OTHER PUBLICATIONS

SSR Ultra Coolant, "A revolutionary Synthetic Coolant, Specially Developed to Keep Your Ingersoll–Rand Air Compressor Working at Peak Effieciency", Ingersoll–Rand Air Compressor (date unknown).

*Primary Examiner*—Jerry D. Johnson

*Attorney, Agent, or Firm*—Cowan, Liebowitz & Latman, P.C.; Michael I. Wolfson

[57] ABSTRACT

A synthetic lubricant composition is a blend of a polyol ester blend admixed with effective amounts of an antioxidant, yellow metal pacifier and rust inhibitors. The polyol ester blend includes a major proportion of poly(neopentyl polyol) ester blend formed by reacting poly(pentaerythritol) with at least one $C_7$ to $C_{12}$ carboxylic acid mixed with an ester formed by reacting a polyol having at least two hydroxyl groups and at least one $C_8$–$C_{10}$ carboxylic acid. Preferably, the acids are linear and avoid those which can cause odors during use. Effective additives include secondary arylamine antioxidants, triozole derivative yellow metal pacifier and an amino acid derivative and substituted primary and secondary amine and/or diamine rust inhibitor.

26 Claims, No Drawings

POLY(NEOPENTYL POLYOL) ESTER BASED COOLANTS AND IMPROVED ADDITIVE PACKAGE

BACKGROUND OF THE INVENTION

This invention relates to synthetic ester compositions and in particular to compositions based on a blend of poly (neopentyl) polyol ester and an ester of a polyol containing at least two hydroxyl groups, which is inhibited with a unique combination of additives. The compositions are particularly well suited for use as a coolant/lubricant in a rotary screw air compressor. The coolant/lubricant compositions minimize use of esters formed from highly odoriferous acids, yet provide extended life, higher temperature operation, excellent demulsibility, biodegradability, rust protection and hydrolytic stability—a combination of properties not available in existing synthetic compressor coolant/lubricant compositions.

It is well known to use hydrocarbon lubricating oils in rotary screw compressors. The oil seals the rotors, lubricates the bearings, cools the compressed gases and removes water condensed from the compressed gases. The high temperature and pressure and presence of water causes the hydrocarbon oils to break down and create sludge in a relatively short time.

Efforts to lengthen the useful life of coolants for air compressors have led to the use of synthetic esters as basestocks. Typical operating temperatures are between about 80° to 104° C. (170° to 220° F.). While these temperatures are not high for a synthetic lubricant, the environment is highly oxidative so that mineral oils tend to break down after about 1,000 hours of use and must be changed. Several of the synthetic coolant/lubricants presently in use extend the intervals between changing lubricants to as much as 8,000 hours.

A synthetic ester coolant based on diesters of adipic acid and phthalic acid have been used for more than 25 years in a variety of compressors including rotary screw compressors. Other synthetic coolants in use are based on synthetic hydrocarbons or poly alpha olefins (PAO's), polyalkylene glycols (PAG's), silicones, and mixtures of synthetic hydrocarbons and dibasic acid esters. All of these products provide extended lubricant life when compared to petroleum based coolants used in the highly oxidative environment in a screw compressor. However, none of the available lubricants are able to provide all of the desired properties, in particular the combination of biodegradability with hydrolytic stability, rust protection, and demulsibility while avoiding offensive odors.

In addition to these performance properties, certain physical properties are required, such as providing efficient cooling, low temperature start-up, sealing of the rotors, and lubrication of the bearings. In particular, the desirable physical properties include a viscosity at 100° C. (212° F.) of at least 8 cSt, a viscosity index of at least 140, a flash point of at least 260° C. (500° F.), and a pour point of at most −50° C. (−58° F.).

A wide operating temperature range for the coolant is highly desirable. In order to permit low temperature starting, a lubricant having a pour point less than −50° C. (−58° F.) is required. Suitable high temperature viscosity properties and low volatility are needed to permit suitable lubrication at higher operating temperatures. Thus, the coolant composition should have a flash point above 260° C. which is required by some manufacturers for safety reasons.

All screw compressor coolant/lubricants will come into contact with water condensed from the compressed air. Therefore, any lubricant must exhibit good hydrolytic stability and provide good rust and corrosion protection. It is an added advantage to provide a lubricant exhibiting good demulsibility. This will permit separation of water from the spent lubricant and facilitate disposal and recycling of the spent lubricant.

Increased biodegradability is also highly desirable. In addition, the elimination of heavy metals, utilized in some commercial coolants, Is also desirable from an environmental point of view.

It is also highly desirable to avoid objectionable odors. Thus, it becomes desirable to avoid or minimize the use of esters formed from carboxylic acids having less than seven carbon atoms. Finally, adequate regulatory listing is desirable.

Existing petroleum based and synthetic air compressor coolant/lubricants are not capable of providing all of the desired performance and physical properties for modern rotary screw compressors. Often, modification of one component of a synthetic lubricant will improve a certain desired property, but at the expense of another. For example, coolants based on PAO's have poor biodegradability; coolants based on adipate diesters cannot provide the viscosity, or flash point properties; coolants based on phthalate diester have poor biodegradability and viscosity indices; coolants based on silicones have poor biodegradability and rust protection; coolants based on polyalkylene glycol have poor demulsibility and inadequate rust protection; and coolants based on mixtures of PAO's and diester do not provide the desired biodegradability.

The following table summarizes the desired properties generally available from current types of rotary screw compressor coolant/lubricants. While several different types may be noted as having satisfactory performance of a particular property, there will be variations within acceptable ranges, some of which may be significant to the user. An "X" indicates that the referenced type of commercially available coolant/lubricant can provide the desired property, and an "O" indicates that it is not fully acceptable.

TABLE 1

SIGNIFICANT DESIRED PROPERTIES FOR ROTARY SCREW COMPRESSOR COOLANT/LUBRICANT COMPOSITIONS

| Desired Properties | Desired* Composition | Mineral Oil | PAO (Polyalpha Olefin) | Diester | PAO/Ester | PAG (PolyAlkylene Glycol) | Silicone | Phosphate | PAG/Ester |
|---|---|---|---|---|---|---|---|---|---|
| Pour Point < −50° C. | x | o | x | o | x | x | x | o | x |
| Flash Point > 260° C. | x | o | o | x | o | x | x | x | x |
| Good Rust Prevention | x | x | x | x | x | o | o | o | o |
| Good Demulsibility | x | x | x | x | x | o | x | o | o |

TABLE 1-continued

SIGNIFICANT DESIRED PROPERTIES FOR ROTARY SCREW COMPRESSOR COOLANT/LUBRICANT COMPOSITIONS

| Desired Properties | Desired* Composition | Mineral Oil | PAO (Polyalpha Olefin) | Diester | PAO/Ester | PAG (PolyAlkylene Glycol) | Silicone | Phosphate | PAG/Ester |
|---|---|---|---|---|---|---|---|---|---|
| Good Hydrolytic Stability | x | x | x | o | x | x | x | o | x |
| Biodegradable | x | o | o | o | o | o | o | o | o |
| Viscosity Index > 140 | x | o | x | o | x | x | x | o | x |

*The poly(neopentyl polyol) ester based compositions prepared in accordance with the invention exhibit all of the desired properties.

One of the most widely used high performance rotary screw compressor coolants is a PAG/ester synthetic lubricant of the type described in U.S. Pat. No. 4,302,343 to Carswell et al. The Carswell PAG/ester lubricant is an inhibited blend of a polyalkylene glycol with hindered alkanoic ester of aliphatic polyhydric alcohols having three to eight hydroxyl groups and five to ten carbon atoms. When properly blended and mixed with additives, the resulting synthetic coolant/lubricant has been found to satisfy the high temperature viscosity requirements and exhibit stability to the heat, air and water environment. However, ferrous metal corrosion resistance and demulsibility has been found less than satisfactory. The presence of the heavy metal barium also presents disposal concerns.

U.S. Pat. No. 4,175,045 to Timony describes a compressor lubricant formed of a polyol ester of a carboxylic acid having from about four to thirteen carbon atoms. The polyols utilized are pentaerythritol, dipentaerythritol, trimethylolpropane, or combinations thereof. The lubricants are blends of the pentaerythritol ester and dipentaerythritol esters. While providing satisfactory useful life and temperature characteristics, the viscosity at 100° C. (212° F.) and pour point do not meet the desired values as set forth in Table I. In addition, the lubricants are based on substantial amounts of esters formed from valeric acid and thus in use present undesirable odor problems. Improvements in rust prevention and demulsibility are also needed.

As noted, the prior art describes a wide variety of synthetic lubricants based on various polyol esters and blends thereof admixed with various additives to improve performance. While these synthetic rotary screw air compressor coolant/lubricants are presently in wide use, it remains desirable to provide an improved coolant/lubricant composition which can provide all the significant desired properties noted in Table I, particularly increased oxidative stability, improved demulsibility, improved rust protection, increased biodegradability and low odor in use.

SUMMARY OF THE INVENTION

Generally speaking, in accordance with the invention, an improved synthetic coolant/lubricant composition for a rotary screw compressor providing superior performance based exclusively on a polyol ester base stock and suitable additives is provided. The ester portion of the composition is a blend of a major amount of poly(neopentyl polyol) ester and a minor amount of a polyol ester formed from a polyol having at least two hydroxyl groups. The composition includes antioxidants, yellow metal pacifiers, rust inhibitors, hydrolytic stability improver and may include an antifoam additive. This unique approach of using a poly (pentaerythritol) ester based preparation was found necessary to obtain all the desired performance properties, particularly the combination of extended life, low pour point, high flash point, good demulsibility and reduced odor. This approach differs from the esters described in the patent literature and synthetic coolant/lubricant compositions in use today.

The poly(neopentyl polyol) ester component is a poly (pentaerythritol) ester formed by esterifying partial esters of pentaerythritol, dipentaerythritol, tripentaerythritol, tetrapentaerythritol, etc. with at least one monocarboxylic acid or a mixture of acids having from about six to twelve carbon atoms. The poly(pentaerythritol) ester is formed by first reacting pentaerythritol with the selected carboxylic acid or a mixture of acids with an excess of hydroxyl groups to carboxyl groups to form the partial esters. In the preferred embodiments, the carboxylic acid is a linear acid having from seven to twelve carbon atoms.

The polyol ester component is utilized to balance the properties of the poly (pentaerythritol) ester, especially to lower the pour point and improve biodegradability without adversely affecting any other desired properties. It is prepared by reacting a hindered polyol having from five to eight carbon atoms and at least two hydroxyl groups with a monocarboxylic acid having from about seven to twelve carbon atoms. In the preferred embodiments, the polyol is trimethylolpropane and the acid is a linear acid having from seven to twelve carbon atoms.

The coolant/lubricant composition is formed by mixing from about 50 to 80 weight percent poly(neopentyl polyol) ester and 20 to 50 percent polyol ester, and adding effective amounts of additives, for example between about 0.5 to 10 weight percent antioxidants, yellow metal pacifier, rust inhibitors and an antifoam agent.

Accordingly, it is the object of the invention to provide an improved rotary screw compressor coolant/lubricant.

Another object of the invention is to provide an improved rotary screw compressor coolant/lubricant of a blend of poly(neopentyl polyol) esters and traditional ester polyol.

A further object of the invention is to provide an improved rotary screw compressor coolant/lubricant having increased oxidative stability, improved demulsibility, improved rust protection, increased biodegradability, and reduced volatility compared to conventional synthetic compressor lubricants.

Yet another object of the invention is to provide an improved additive package designed to provide improved demulsibility, enhanced rust protection and improved hydrolytic stability for a synthetic ester rotary screw compressor coolant/lubricant.

Yet a further object of the invention is to provide a method of lubricating a rotary screw compressor with a coolant/lubricant composition based entirely on polyol esters.

Another object of the invention is to provide a synthetic ester rotary screw compressor coolant/lubricant meeting all the desired properties without including significant amounts of esters based on acids having unpleasant odors.

Still another object of the invention is to provide a method of lubricating a rotary screw compressor with a coolant/lubricant composition based on a blend of poly(neopentyl polyol) esters and polyol esters.

Still a further object of the invention is to provide a new additive package for a synthetic ester lubricant to improve rust protection, hydrolytic stability and demulsibility.

Still other objects and advantages of the invention will in part be obvious and will in part be apparent from the specification.

The invention accordingly comprises a composition of matter possessing the characteristics, properties, and the relation of components which will be exemplified in the composition hereinafter described, and the scope of the invention will be indicated in the claims.

DESCRIPTION OF THE PREFERRED EMBODIMENTS

The polyol ester based compressor coolant/lubricant compositions prepared in accordance with the invention include a polyol ester blend and performance additives designed to provide improved demulsibility, biodegradability, provide excellent ferrous metal rust prevention and improved hydrolytic stability. There are no odoriferous heavy components or metals in the composition.

The synthetic ester portion of the lubricant is a blend of poly(neopentyl polyol) ester and polyol ester. The lubricant includes from about 50–80 weight percent of the poly (neopentyl polyol) ester and from about 20 to 50 weight percent polyol ester. Preferably, the poly(neopentyl polyol) ester is present between about 55 to 75 weight percent, and in the most preferred embodiments, between about 65–70 weight percent, based on the total weight of the composition with the balance the polyol ester and the additives.

Preferably, the poly(neopentyl polyol) ester, which is a mixture of partial esters of pentaerythritol, dipentaerythritol, tripentaerythritol, tetrapentaerythritol, etc. formed by reacting pentaerythritol with at least one monocarboxylic acid having from about 6 to 12 carbon atoms in the presence of an excess of hydroxyl groups to carboxyl groups. Most preferably, the acids have from 7 to 10 carbon atoms and are linear. In the most preferred aspects of the invention, the acid component of the poly(neopentyl polyol) ester is a linear monocarboxylic acid, or a mixture of linear acids with about five weight percent or less branched acid.

Acids having less than seven carbon atoms are not within the scope of the invention, because they may impart objectionable odors in use. Suitable acids include, but are not limited to oenanthic acid, caprylic acid, pelargonic acid and capric acid. Preferably, the straight chain acid is a mixture of heptanoic ($C_7$) and caprylic-capric ($C_8$–$C_{10}$). The caprylic-capric acid is usually identified as being a mixture of 8 and 10 carbon acids, but actually includes $C_6$ to $C_{12}$ acids, including trace amounts of $C_6$ acid (less than about 5 weight %). Use of only linear acids to prepare the esters adds to the biodegradability and viscosity index of the coolant/lubricant composition.

The initial stage of the reaction to form the poly (neopentyl polyol) esters is conducted in the manner described by Leibfried in U.S. Pat. No. 3,670,013. The neopentyl polyol and selected acid or acid mixture are mixed in the presence of a strong acid catalyst and heated. The reaction is continued until the desired viscosity of the reaction mixture is reached. At this point when the starting neopentyl polyol is pentaerythritol, the mixture includes partial esters of pentaerythritol, dipentaerythritol, tripentaerythritol, tetrapentaerythritol and the like. In order to complete the esterification of the partial esters, an excess of the acid is added to the reaction mixture which is then heated, water of reaction removed and acid returned to the reactor.

In U.S. Pat. No. 3,670,014, Leibfried describes preparing partial esters of poly (neopentyl polyols) from certain neopentyl polyols and certain aliphatic monocarboxylic acids. Specifically, at column 2, beginning at line 49, he states that the initial concentration of aliphatic monocarboxylic acid material in the reaction mixture is such as to provide an initial mole ratio of carboxyl groups to hydroxyl groups in a range from about 0.25:1 to about 0.5:1. He states that higher and lower mole ratios are within his invention, and that "a mole ratio less than about 0.25:1 results in dark products with high levels of impurities, while a mole ratio greater than about 0.5:1 tends to favor the esterification reaction and block the condensation reaction."

In a specific example Leibfried prepares a reaction mixture of pentaerythritol (272 w) and valeric acid (217 v) in a reactor with extra valeric acid (38 v) in a condenser to assure a constant level of valeric acid in the reaction mixture. The mixture was heated to a temperature of 171° C. and concentrated sulfuric acid (1.0 w) diluted with water (2 v) was added. The reaction mixture was heated to 192° C. and maintained until 50.5 v of water was removed after about 1.4 hours. The resulting mixture is described as the desired partial ester product made up of partial esters of polypentaerythritols and valeric acid.

The amount of the preferred heptanoic and caprylic-capric acid mixture for preparing the poly(neopentyl polyol) ester may vary widely. Initially, an excess of hydroxyl groups to carboxylic acid groups is present to form the partial esters of pentaerythritol, dipentaerythritol, tripentaerythritol, tetrapentaerythritol, etc. The excess of hydroxyl groups is necessary to promote the condensation of the polyol into partial esters during the reaction. The molar ratio of acid mixture to the polyol can be varied depending on the desired degree of condensation and the ultimate desired viscosity of the lubricant.

After formation of the partial esters, generally, a 10 to 25 percent excess of the mixture of heptanoic acid and $C_8$–$C_{10}$ acid is added to the reactor vessel and heated. Water of reaction is collected during the reaction while the acids are returned to the reactor. Presence of a vacuum will facilitate the reaction. When the hydroxyl value is reduced to a sufficiently low level, the bulk of the excess acid is removed by vacuum distillation. Any residual acidity is neutralized with an alkali. The resulting poly(neopentyl polyol) ester is dried and filtered.

The polyol ester preferably is an ester of a polyol having between 5 and 8 carbon atoms and at least two hydroxyl groups and a linear monocarboxylic acid having from 7 to 12 carbon atoms. Specific examples of polyol useful in the present invention include neopentyl glycol, pentaerythritol, dipentaerythritol, tripentaerythritol, trimethylolpropane, trimethylolethane, etc. Mixtures of any of the above polyol can be utilized.

The acid component of the polyols ester can be the same or vary from that utilized to prepare the poly(neopentyl polyol) ester. Accordingly, monocarboxylic acids having between about 7 to 12 carbon atoms, such as heptanoic ($C_7$) and caprylic-capric ($C_8$–$C_{10}$) with minimal $C_6$ and lower acids are preferred. In the most preferred embodiments, a linear acid, namely caprylic-capric acid is utilized to form the polyol ester. The amount of acid present in the reaction mixture can vary widely. Since the desire is to completely esterify the polyol, an excess generally in the amount of between about 10 to 25 percent excess acid relative to the stoichiometric amount is added.

The polyol ester is formed by reacting the polyol with an excess of the carboxylic acid, removing the water of reaction and returning the unreacted acid to the heated reactor vessel. The reactor is equipped with a mechanical stirrer, thermocouple, thermoregulator, Dean Stark trap, condenser, nitrogen sparger and vacuum source. The esterification may or may not be carried out in the presence of an esterification catalyst, which are well known in the art, such as stannous oxalate. The polyol is preferably trimethylolpropane which is esterified with a $C_8$–$C_{10}$ acid to form the desired triester. The trimethylolpropane-$C_8$–$C_{10}$ triester is blended with the poly(pentaerythritol) esters to form the lubricant so that the triester is present between about 20 to 50 weight percent of the lubricant, preferably between about 25 to 40 weight percent. In the preferred embodiment about 30 to 35 weight is percent is used.

The polyol, and the monocarboxylic acid in excess of about 10 to 15 percent, are charged to the reactor vessel. The vessel is heated and water of reaction is collected in the trap during the reaction. The acids are returned to the reactor. Vacuum is applied to maintain the reaction. When the hydroxyl value is reduced to a sufficiently low level, the bulk of the excess acid is removed by vacuum distillation. The residual acidity is neutralized with an alkali. Finally, the resulting polyol ester product is dried and filtered.

In order to improve the properties of the (polyneopentyl polyol) based ester compositions prepared in accordance with the invention as coolant/lubricants, effective amounts of various additives are added. For example, the oxidative stability of the ester based coolant/lubricant can be improved by adding an effective amount of at least one antioxidant. Examples of suitable antioxidants which can be used are secondary arylamines, and phenyl naphthylamines, i.e. both alpha and beta-naphthyl amines; diphenyl amine; iminodibenzyl; p, p'-dioctyl-diphenylamine; and related aromatic amines. Other suitable antioxidants are hindered phenolics, such as 2-t-butylphenol, 2,6-di-t-butylphenol and 4-methyl-2,6-di-t-butylphenol and the like.

Generally, between about 0.5 to 10 weight percent antioxidant is included in the ester composition. Preferably, between about 1 to 5 weight percent is included. The preferred antioxidant is a mixture of secondary arylamines, such as dioctyldiphenyl amine and phenylalphanaphthyl amine. When these two latter amines are utilized in combination, between about 0.01 to 5 weight percent of each is included, and preferably between about 0.1 to 0.5 weight percent of each is included.

A rust inhibitor is included to inhibit ferrous metal corrosion which is a serious problem due to the condensation of water from the compressed gases. Rust inhibitors have traditionally been compounds containing heavy metals which are desirable to avoid. However, a combination of amino acid derivatives with substituted primary and secondary amines have been found to provide a synergistic effect—not only providing improved ferrous metal rust prevention and improved hydrolytic stability, but doing this without adversely affecting demulsibility. The amino acid derivative found suitable is available as KCORR-100E (50% active) from King Industries which is an N-acyl-N- alkoxyalkyl substituted amino acid ester and a mixture of substituted amines known as Duomeen TDO and Ethomeen T-12 from Akzo Nobel. The Duomeen TDO from Akzo Nobel is N-tallow-1,3-propylenediamine oleate and has been assigned CAS Registry No. 61791-53-5 by the Chemical Abstracts Service administered by the American Chemical Society. It is a fatty acid salt of a tallow and substituted alkylene diamine. The Ethomeen T-12 is N,N-Bis (2-hydroxyethyl)(tallow alkyl) amine and has been assigned CAS # 61791-44-4. It is a tertiary amine substituted with two ethanol groups and a tallow alkyl group. These rust inhibitors are utilized in combination to maintain good demulsibility, and provide excellent rust prevention and improved hydrolytic stability.

The amino acid derivative and substituted amines and diamines present as rust inhibitors are included in an amount between about 0.05 to 10 weight percent of the lubricant. Preferably, between about 0.1 to 6 weight percent is included. In the preferred embodiments, a total of about 0.50 weight percent of the rust inhibitor, such as KCORR-100E, Ethomeen T-12 and Duomeen TDO, are included.

Cuprous metal deactivators, known as yellow metal pacifiers, may also be included. Examples are imidazole, benzimidazole, pyrazole, benzotriazole, tolyltriazole, 2-methyl benzimidazole, 3,5-dimethylpyrazole and methylene bis-benzotriazole. Preferably, an aryltriazole, such as tolyltriazole is utilized. Such a yellow metal pacifier is included in an effective amount, generally about 0.001 to 0.5 weight percent of the lubricant. Preferably, between about 0.01 to 0.2 weight percent is included. In the preferred embodiment, about 0.05 weight percent tolyltriazole is utilized as a yellow metal pacifier.

In addition to these antioxidants, yellow metal pacifiers and rust inhibitors, it may be desirable to include an effective amount of a defoamer which will prevent undesirable foaming of the lubricant as it is worked between the screws of the compressor. A silicone fluid present in a minor amount is effective. Generally, about 0.001–10 parts per million of defoamer is sufficient. In the preferred embodiment, about 1 ppm is utilized.

The lubricant is formed by placing the desired amounts of the poly(neopentyl polyol) ester and the polyol ester blend in a vessel equipped with a mechanical agitator, thermocouple, thermoregulator and nitrogen sparge. The mixture is heated to approximately 100° C. (212° F.). At this time, the antioxidants and yellow metal pacifier additives are added and agitated until dissolved. The mixture is cooled to less than 50° C. (122° F.) and the amino acid derivative, and mixture of substituted primary and secondary amines are added. The mixture is agitated, filtered and then defoamer added.

The ester coolant/lubricants prepared in accordance with the invention are specifically designed to be utilized in a rotary screw air compressor. Accordingly, it is designed to have a viscosity in the range of about 5 to 15 centistokes at 100° C. (212° F.) and preferably 7 to 10 centistokes at 100° C. (212° F.) and a pour point in the range of about −29° to −54° C. (−20° to −65° F.).

The invention will be better understood with reference to the following examples. All percentages are set forth in percentages by weight, except where molar quantities are indicated. These examples are presented for purposes of illustration only, and not intended to be construed in a limiting sense.

EXAMPLE 1

A poly(neopentyl) polyol ester based coolant/lubricant prepared in accordance with the invention was made as follows. Into a vessel equipped with a mechanical agitator, thermocouple, thermoregulator and nitrogen sparge was charged the poly(pentaerythritol) ester and trimethylolpropane ester in the quantity set forth in Table II. The ester mixture was heated to approximately 100° C. When the mixture reached 100° C., the secondary arylamines and a triazole derivative were added and agitated until dissolved. The mixture was then cooled to less than 50° C. and the amino acid derivative, and substituted and amines were added to the mixture. The mixture was agitated thoroughly, filtered, and then defoamer added.

TABLE II

| COMPONENT | WEIGHT % |
|---|---|
| Polypentaerythritol ester | 66 |
| Trimethylolpropane ester | 32 |
| Dioctyldiphenylamine (secondary arylamine) | 0.9 |
| Phenylalphanapthylamine (secondary arylamine) | 0.9 |
| Tolyltriazole (triazole) | 0.05 |
| K-Corr 100E (amino acid derivative) | 0.25 |
| Ethomeen T-12 | 0.17 |

TABLE II-continued

| COMPONENT | WEIGHT % |
|---|---|
| Duomeen TDO | 0.08 |
| Silicone fluid (defoamer) | 1 ppm |

EXAMPLE 2

The poly(neopentyl) polyol ester based coolant/lubricant composition prepared in accordance with the invention as described in Example 1 was analyzed to determine its physical properties. Utilizing the same ASTM tests, a sample of a commercially available rotary screw compressor lubricant denominated SSR Ultra (the current industry standard) and believed prepared in accordance with the Carswell U.S. Pat. No. 4,302,343 was also tested. The results of the comparison of physical and chemical properties and performance characteristics is as set forth in Table III.

TABLE III

Physical and Performance Properties

| PROPERTY | EXAMPLE 1 PREPARATION | SSR ULTRA (Current Standard) | TEST METHOD |
|---|---|---|---|
| Viscosity @ 100° C. (212° F.) | 8.48 | 8.82 | ASTM D 445 |
| (cSt) @ 40° C. (104° F.) | 48.4 | 48.5 | ASTM D 445 |
| ISO Viscosity Grade | 46 | 46 | ASTM D 2422 |
| Viscosity Index | 153 | 163 | ASTM D 2270 |
| Pour Point, ° C. (° F.) | −51 (−60) | −50 (−58) | ASTM D 97 |
| Flash Point, ° C. (° F.) | 274 (525) | 282 (540) | ASTM D 92 |
| Fire Point, ° C. (° F.) | 307 (585) | 299 (570) | ASTM D 92 |
| Heavy Metal Content, % | None | 1,200 ppm Barium | Atomic Emission |
| Fatty Acids < $C_7$, Wt. % | None* | 12 | GC |
| Demulsibility @ 130° F., minutes | 25 | No separation (3 days) | ASTM D 1401 |
| Biodegradability, % | 85.4 | 66.8 | CEC L-33-A-93 |
| Ferrous Metal Corrosion | | | |
| Sea Water @ 24 hrs. | Pass (no rust) | Fail | ASTM D 665 |
| Sea Water @ 48 hrs. | Pass (no rust) | Fail | B |
| Rotary Bomb Oxidation Hours to 25 psi drop | 15.0 | 10.1 | ASTM D 2272 |
| Modified Rotary Bomb Oxidation | | | |
| Pressure Drop @ 15 hrs, 10% H2O, psi | 20 | 44 | |
| Pressure Drop @ 15 hrs, 0% H2O, psi | 3 | 20 | |
| Hydrolytic Stability 48 hrs. @ 93.3° C. (200° F.) | | | ASTM D 2619 |
| % Visc. change @ 40° C. | −0.2 | +1.4 | |
| Oil acid change, mgKOH/g | +.32 | +.04 | |
| Water acid change, mgKOH/g | +.11 | +.72 | |
| Evaporation Rate, % loss 6.5 hrs @ 400° F. | 1.34 | 5.58 | ASTM D 972 |
| Volatility @ 400° F., % loss | | | Hatco Method |
| @ 6 hrs. | 0.1 | 0.4 | |
| @ 21 hrs. | 0.3 | 0.9 | |
| @ 55 hrs. | 0.9 | 3.0 | |
| @ 83 hrs. | 1.2 | 3.9 | |

*Includes trace amounts of $C_6$ from commercially available $C_8$–$C_{10}$ acid.

A comparison of the chemical and physical properties shows that the coolant/lubricant composition prepared in accordance with the invention as set forth in Example 1 meets and/or exceeds each of the chemical and physical properties relevant for use as a compressor coolant/lubricant. A review of the performance tests in Example 2, shows that the coolant/lubricant of Example 1 significantly exceeds each of the performance characteristics considered important for a lubricant to be used in a rotary screw air compressor.

EXAMPLE 3

A sufficient quantity of coolant/lubricant prepared in accordance with Example I was placed in three different rotary screw air compressors of 5, 7.5 and 30 horsepower. The condition of the fluid was inspected at 500 hour intervals. After running the 30 hp compressor for 3000 hours, the coolant/lubricant was inspected and tested and found to exceed the minimum specifications as called for in Table I.

These remarkable results obtained in accordance with the invention are due to the synergistic effect of the ester blend and additives, namely major amount of the (neopentyl polyol) combined with the polyol ester and the amino acid derivative and mixture of substituted amines rust inhibitors. The improvement in rust prevention and hydrolytic stability is achieved without any negative impact on biodegradability, demulsibility or oxidative stability. These improvements are attained without the use of any heavy metal containing compounds which greatly facilitates disposal of spent lubricant.

It will thus be seen that the objects set forth above, among those made apparent from the preceding description, are efficiently attained and, since certain changes may be made in the above composition of matter without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A synthetic coolant/lubricant composition comprising an ester mixture of:

about 50 to 80 weight percent of polypentaerythritol ester formed by (i) reacting pentaerythritol with at least one linear monocarboxylic acid having from 7 to 12 carbon atoms in the presence of an excess of hydroxyl groups in a mole ratio of carboxyl groups to hydroxyl groups in the reaction mixture in a range from about 0.25:1 to about 0.50:1 and an acid catalyst to form partial polypentaerythritol esters and (ii) reacting the partial polypentaerythritol esters with an excess of at least one linear monocarboxylic acid having from 7 to 12 carbon atoms, and about 20 to 50 weight percent of a polyol ester formed by reacting a polyol having 5 to 8 carbon atoms and at least two hydroxyl groups with at least one linear monocarboxylic acid having from 7 to 12 carbon atoms, the linear acids including less than about five weight percent branched acids with the weight percents of the esters in the blend based on the total weight of the composition.

2. The composition of claim 1, wherein the ester mixture includes between about 55 to 75 weight percent polypentaerythritol ester and about 25 to 40 weight percent polyol ester.

3. The composition of claim 1, wherein the carboxylic acid is selected from the group consisting of $C_7$ and $C_8$–$C_{10}$ acids and mixtures thereof.

4. The composition of claim 1, wherein the polypentaerythritol ester is formed by reacting a linear carboxylic acid having between about 65 to 85 mole percent $C_7$ acid and the balance $C_8$–$C_{10}$ acid.

5. The composition of claim 1, wherein the polyol ester is formed by reacting a polyol having three hydroxyl groups.

6. The composition of claim 1, wherein the polyol ester is a triester.

7. The composition of claim 6, wherein the polyol is trimethylolpropane.

8. The composition of claim 1, wherein the linear carboxylic acid used to form the polyol ester is a $C_8$–$C_{10}$ linear acid.

9. The lubricant composition of claim 1, wherein the polyol ester is the reaction product formed by reacting trimethylolpropane and $C_8$–$C_{10}$ linear acid.

10. The composition of claim 1, wherein the polypentaery 2 ester is the reaction product formed by reacting poly (pentaerythritol) partial ester and a mixture of $C_7$ and $C_8$–$C_{10}$ linear acids.

11. The composition of claim 1, further including effective amounts of at least one of each of an antioxidant, a rust inhibitor and a yellow metal pacifier.

12. The composition of claim 11, wherein the antioxidant is a secondary arylamine, the yellow metal pacifier is a triazole derivative and the rust inhibitor is a mixture of an amino acid derivative and substituted secondary and tertiary amines and/or their fatty acid salts.

13. The lubricant composition of claim 12, wherein the amino acid derivative in the rust inhibitor is an N-acyl-N-alkoxyalkyl amino acid derivative.

14. The composition of claim 13, wherein the amino acid derivative is an N-acyl- N-alkoxyalkyl aspartate ester.

15. The composition of claim 11, comprising an effective amount of an N-acyl-N-alkoxyalkyl aspartate ester and at least one substituted amine and/or its fatty acid salt for improving the rust resistance of the ester lubricant.

16. The composition of claim 15, wherein the amine is a substituted propylene diamine fatty acid salt.

17. The composition of claim 16, wherein the diamine is substituted with an alkyl tallow group.

18. The composition of claim 16, wherein the fatty acid is oleic acid.

19. The composition of claim 15, wherein the diamine is a substituted ethoxylated tertiary amine.

20. The composition of claim 19, wherein the amine is substituted with an alkyl tallow group.

21. The composition of claim 15, wherein the amine is a substituted propylene diamine.

22. The composition of claim 21, wherein the amine is a secondary amine substituted with an alkyl tallow group.

23. A method of cooling and lubricating a compressor which comprises contacting moving components of the compressor to be cooled and lubricated with an effective amount of a synthetic lubricant, comprising a blend of esters formed by mixing (i) the reaction product of a poly (neopentyl polyol) ester formed by (a) reacting a neopentyl polyol with at least one linear monocarboxylic acid having from 7 to 12 carbon atoms, in the presence of an acid) catalyst and an excess of hydroxyl groups in a mole ratio of carboxyl groups to hydroxyl groups in the reaction mixture in a range from about 0.25:1 to about 0.50:1, to form partial poly(neopentyl polyol) esters of the polyol, and (b) reacting the partial poly(neopentyl polyol) esters of the polyol with an excess of at least one linear monocarboxylic acid having from 7 to 12 carbon atoms, and (ii) the polyol ester reaction product of a polyol having 5 to 8 carbon atoms and at least two hydroxyl groups and at least one linear monocarboxylic acid having from 7 to 12 carbon atoms.

24. The method of cooling and lubricating a compressor of claim 23, wherein the compressor is a rotary screw compressor.

25. The composition of claim 1, wherein the poly (pentaerythritol) ester is present between about 55 to 75 weight percent and the linear acids have between 7 and 10 carbon atoms.

26. The composition of claim 1, wherein the partial polypentaerythritol esters are reacted with a 10 to 25 percent excess of the linear acid.

* * * * *